US006109436A

United States Patent [19]

He

[11] Patent Number: 6,109,436

[45] Date of Patent: Aug. 29, 2000

[54] STRUCTURE OF TOOL HOLDING SEAT FOR A TOOL BOX OR THE LIKE

[76] Inventor: Cheng-I He, P.O. Box 82-144, Taipei, Taiwan

[21] Appl. No.: 09/333,016

[22] Filed: Jun. 15, 1999

[51] Int. Cl.[7] ..... B65D 85/28

[52] U.S. Cl. ..... 206/373; 206/378

[58] Field of Search ..... 206/349, 372, 206/373, 374–379, 493; 211/70.6; 24/297, 324

[56] References Cited

U.S. PATENT DOCUMENTS

| | | | |
|---|---|---|---|
| 1,712,473 | 5/1929 | McWethy | 206/378 |
| 3,583,556 | 6/1971 | Wagner | 206/373 |
| 5,056,661 | 10/1991 | Balzano | 206/372 |
| 5,301,396 | 4/1994 | Benoit | 24/297 |
| 5,368,164 | 11/1994 | Bennett et al. | 206/379 |
| 5,423,404 | 6/1995 | Shaw | 206/372 |
| 5,813,531 | 9/1998 | Kao | 206/378 |
| 5,848,694 | 12/1998 | Newton | 206/378 |

*Primary Examiner*—Paul T. Sewell
*Assistant Examiner*—Luan K. Bui
*Attorney, Agent, or Firm*—A & J

[57] ABSTRACT

An improved structure of tool holding seat for a tool box or the like having a tool box cover enclosing an interior positioning board, a zipper formed along the edges of the box to provide zipping of the tool box is disclosed. The present invention is characterized in that a plurality of engaging members are provided on the top surface of the tool holding seat and the top surface of the engaging member is provided with a linear slot or a cross-shaped slot to form a flexible engaging element. A plurality of protruded dovetails are provided to detachably mount the tool holding seat onto the interior positioning board after the protruded dovetails pass through a corresponding circular pad and a corresponding circular hole provided on the tool holding seat, thereby a plurality of sleeves for wrench are inserted into the engaging members, which can be easily taken down for application, and the tool holding seat can be detachably replaced to accommodate the numbers and types of tools.

1 Claim, 9 Drawing Sheets

STRUCTURE OF TOOL HOLDING SEAT FOR A TOOL BOX OR THE LIKE

BACKGROUND OF THE INVENTION a) Technical Field of the Invention

The present invention relates to an improved tool holding seat for a tool box or the like, and in particular, to a tool holding seat which is provided with a plurality of engaging members having a cross-shaped slot or a linear slot on the surface thereof for the detachably engagement of tools (a plurality of sleeves for wrenches).

b) Description of the Prior Art

Conventional tool box 1A structure for holding a plurality of sleeves 51 for wrenches or the tips 52 of screwdrivers is normally provided with a row of connected insertion caps 6 (as shown in FIG. 9) such that the sleeves 51 or the tips 52 can be inserted into the caps 6. The connected insertion caps 6 is then positioned within the tool box 1A. The conventional insertion caps 6 is provided with a plurality of cylindrical caps of specific diameter and are only adaptable to sleeves of specified diameters similar to that of the caps. Another drawback of this connected caps 6 is that the entire structure of the insertion caps 6 has to be removed from the tool box 1A even when a sleeve 51 is needed to be removed for application. In addition, the positioning of the sleeves 51 into the insertion caps is either too loose or too tight as a result of expansion when it is heated under hot weather or contraction when it is cooled.

A further drawback of another type of conventional tool mounting structure is that a plurality of slots for the positioning of sleeves and screwdrivers are formed within the tool box. However, it is not economical with respect to packaging, and production. In view of the above, it is the aim of the inventor to provide a tool holding seat of a tool box or the like which can overcome the above drawbacks.

SUMMARY OF THE INVENTION

Accordingly, the present invention relates to an improved structure of tool holding seat for a tool box or the like having a tool box cover enclosing an interior positioning board, a zipper formed along the edges of the box to provide zipping of the tool box, characterized in that a tool holding seat having a top surface being mounted with a plurality of engaging members, arranged at an equal interval to each other, wherein the top surface of the engaging member is provided with either a linear slot or a cross-shaped slot to form an elastic engaging element, is mounted onto the interior positioning board and along one vertical edge of the tool box, a screwdriver tip holding seat having a plurality of clipping members, being arranged on the surface of thereof and at equal interval to each other, is mounted onto the interior position board and along the other vertical edge of the tool box, and a plurality of protruded dovetails to detachably mount the tool holding seat onto the interior positioning board after the protruded dovetails pass through a corresponding circular pad and a corresponding circular hole provided on the tool holding seat, thereby a plurality of sleeves for wrench are inserted into the engaging members, which can be easily taken down for application, and the tool holding seat can be detachably replaced to accommodate the numbers and types of tools.

It is an object of the present invention to provide an improved structure of tool holding seat for a tool box or the like, wherein, a plurality of substantially square-shaped engaging members are provided with either a cross-shaped slot or a linear slot at the top thereof, and the engaging members are flexible to engaging a sleeve, and a positioned sleeve will not be easily dislocated.

It is another object of the present invention to provide an improved structure of tool holding seat for a tool box or the like, wherein the base seat of the tool holding seat can be detachably mounted with the interior positioning board of the tool box by means of the circular holes of the base seat and a plurality of protruded dovetails. Thus, the tool holding seat can be changed based on the needs of the user with respect to the quantity of the sleeves and the types of the sleeves to be positioned thereto.

It is yet another object of the present invention to provide an improved structure of tool holding seat for a tool box or the like, wherein the tool holding seat can either be a separate unit or a combined unit, so that the sleeves or tips of screwdrivers can be first mounted on the engaging members and then mounted onto the tool box. Thus, the tool holding seat provides a rapid method of positioning the tools within the tool box.

Another object of the present invention is to provide an improved structure of tool holding seat for a tool box or the like, wherein a tool board having a plurality of holes being mounted with a plurality of protruded dovetails, such that the protruded dovetails are used to fasten the tool holding seat.

These and other features and advantages of the present invention will be apparent to those of ordinary skill in the art in view of the detailed description of the preferred embodiment, which is made with reference to the drawings, a brief description of which is provided below.

DETAILED DESCRIPTION OF THE PREFERRED EMBODIMENT

Figure 1:
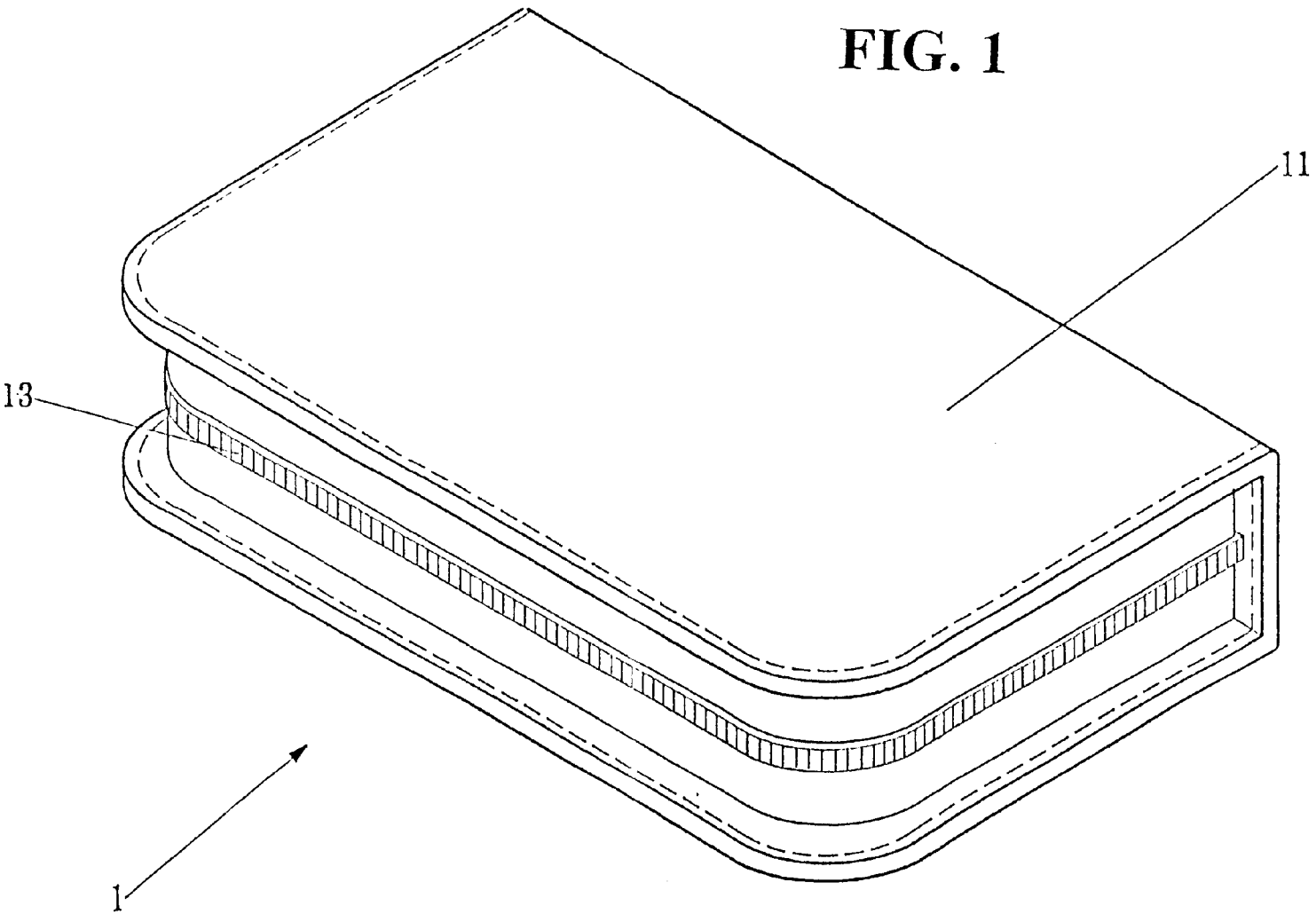
FIG. 1 is a perspective view of a tool box of the present invention.
Figure 2:
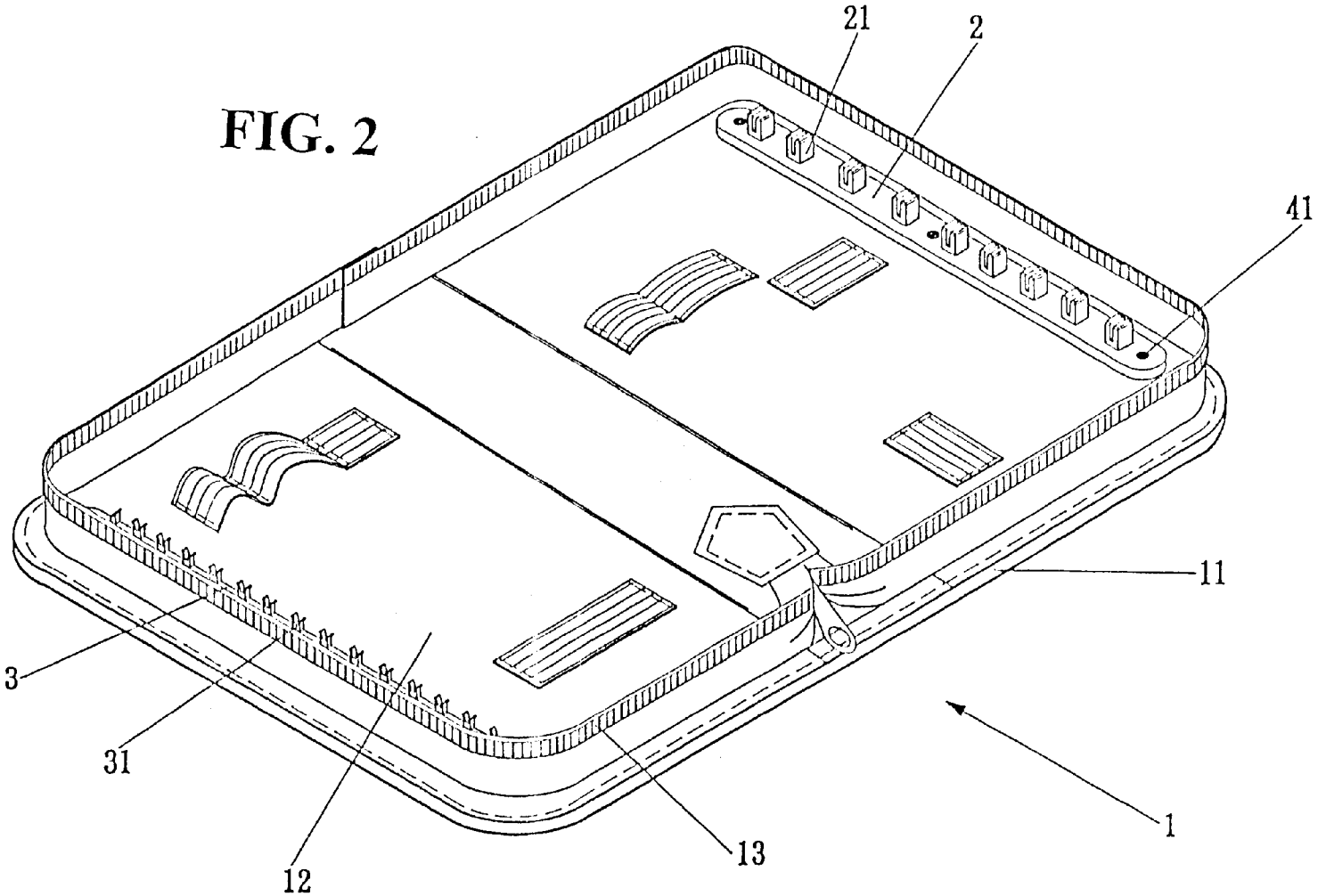
FIG. 2 is a perspective view of a tool box, showing the opening of the box, in accordance with the present invention.
Figure 3:
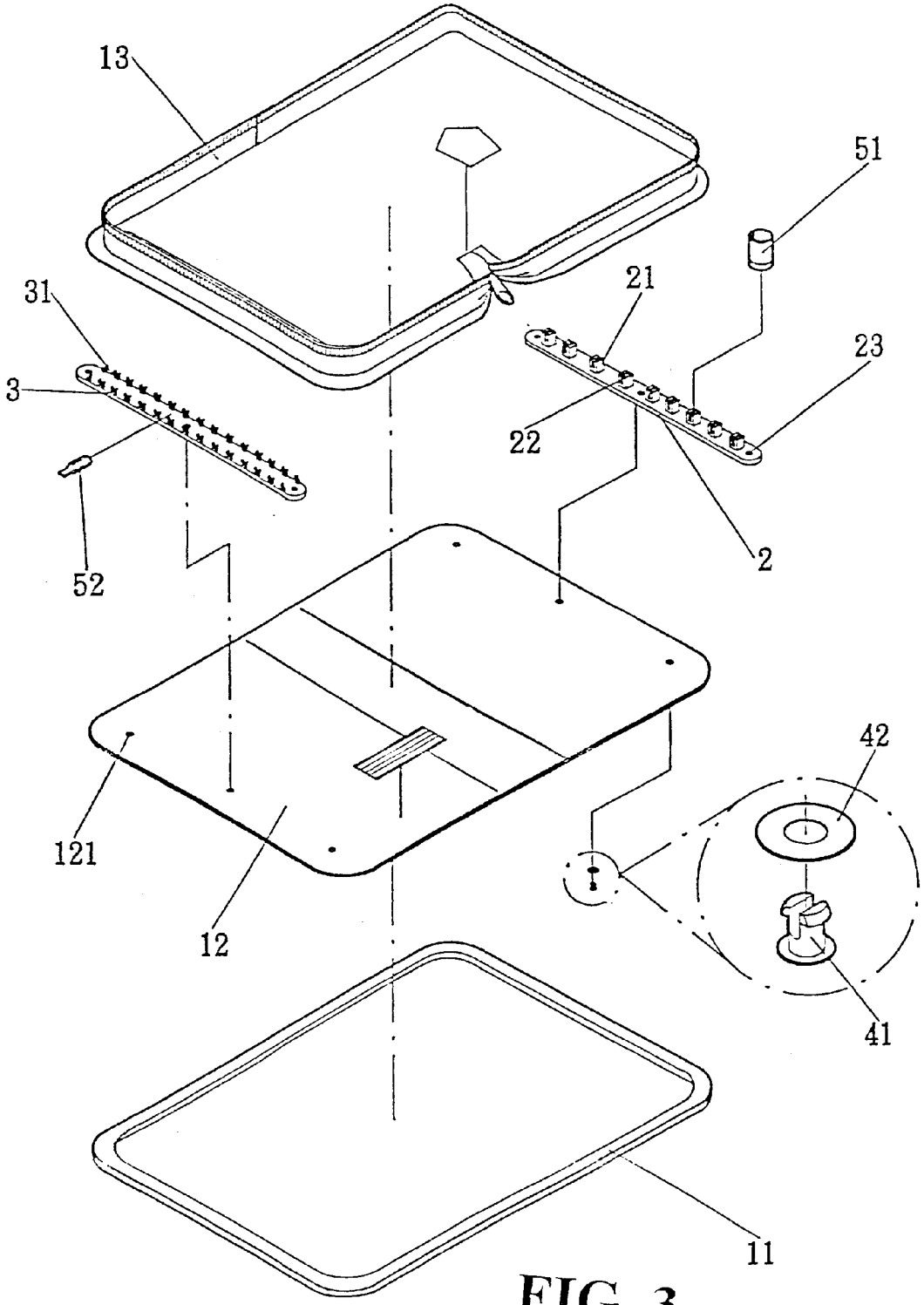
FIG. 3 is a perspective exploded view of the tool box of the present invention, illustrating the square-shaped engaging members on the top surface of the tool holding seat, and shows the detailed view of the tool holding seat.
Figure 6:
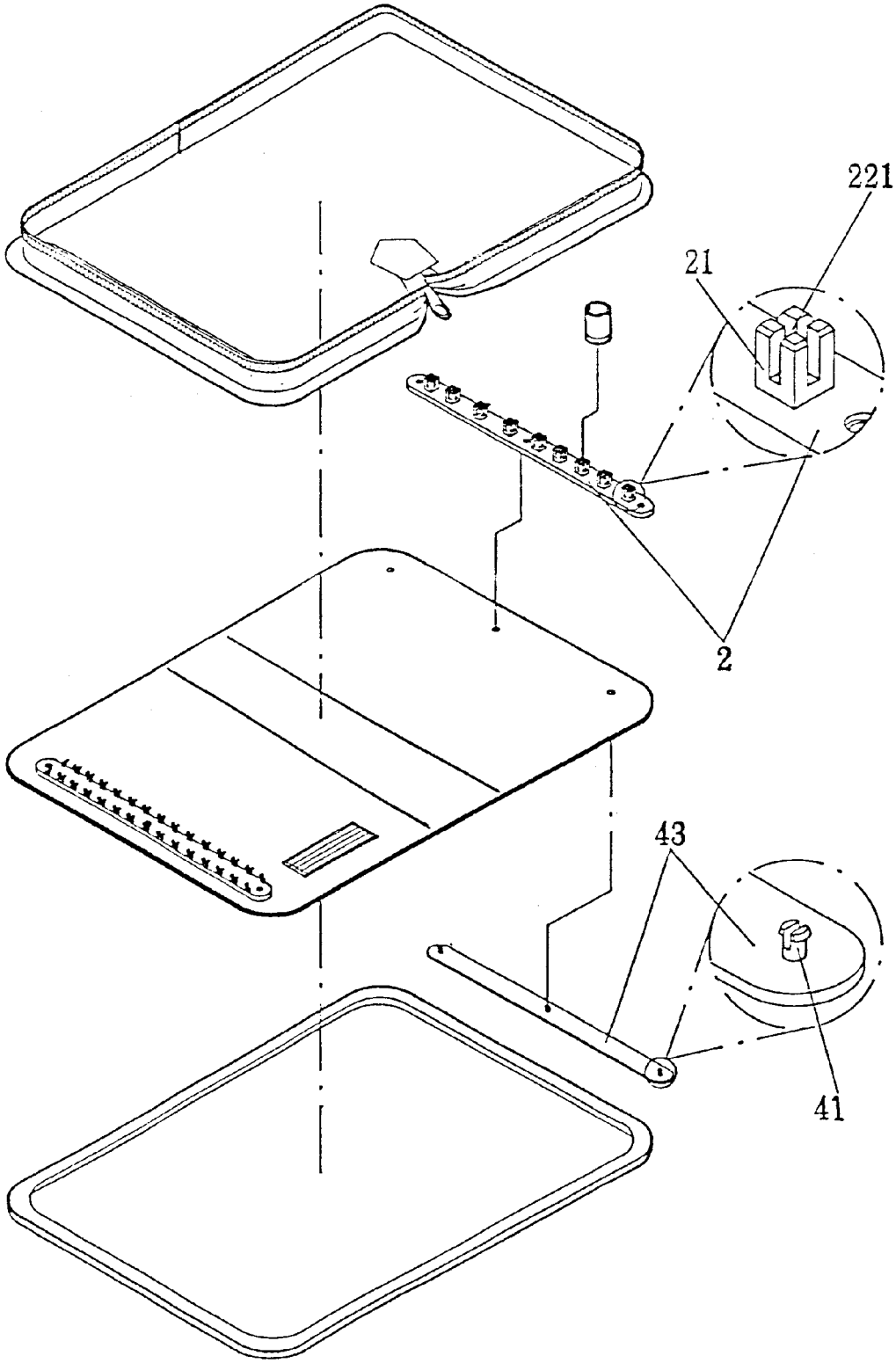
FIG. 6 shows the structure of the engaging member which is mounted onto the tool holding seat, and also shows the protruded dovetail provided to the interior positioning board, of the present invention.

Referring to FIGS. 1, 2 and 3, there are drawings showing the perspective view of the tool box, the perspective view of an opened tool box and the exploded view of the present invention. In accordance with the present invention, the present improved structure of tool holding seat for a tool box 1 or the like having a tool box cover 11 enclosing an interior positioning board 12, a zipper 13 formed along the edges of the box 1 to provide zipping of the tool box 1, characterized in that a tool holding seat 2 having a top surface being mounted with a plurality of engaging members 21, arranged at an equal interval to each other, wherein the top surface of the engaging member 21 is provided with either a linear slot 22 or a cross-shaped slot 221 (as shown in FIG. 6) to form an elastic engaging element, is mounted onto the interior positioning board 12 and along one vertical edge of the tool box 1; a screwdriver tip holding seat 3 having a plurality of clipping members 31, being arranged on the surface of thereof and at equal interval to each other, is mounted onto the interior position board 12 and along the other vertical edge of the tool box 1, and a plurality of protruded dovetails 41 to detachably mount the tool holding seat 2 onto the interior positioning board 12 after the protruded dovetails 41 pass through a corresponding circular pad 42 or an elongated pad 43 (as shown in FIG. 6), a round hole 121 provided on the interior positioning board 12 and a corresponding circular hole 23 provided on the tool holding seat 2.

In accordance with the present invention, the protruded dovetail 41 is inserted into the circular pad 42 first and then inserted from the bottom face of the interior positioning board 12 and out from the surface of the positioning board 12. The tool box cover 11 enwraps the bottom face of the interior positioning board 12 and then detachably fastened with the zipper 13 (as shown in FIG. 1). The circular hole 23 at (the base seat of) the tool holding seat 2 is aligned and corresponding with the protruded dovetail 41 and then is positioned with the tool holding seat 2. In accordance with the present invention, the sleeves 51 of wrench (not shown) are arranged onto the engaging members 21 for easy and convenient application.

In accordance with the present invention, on the other vertical edge of the interior positioning board 12, a screwdriver tip holding seat 3 (as shown in FIG. 3) is provided thereto, wherein a plurality of clipping members 31 are mounted on the tip holding seat 3 for the mounting of tip 52 of the screwdrivers.

Figure 4:
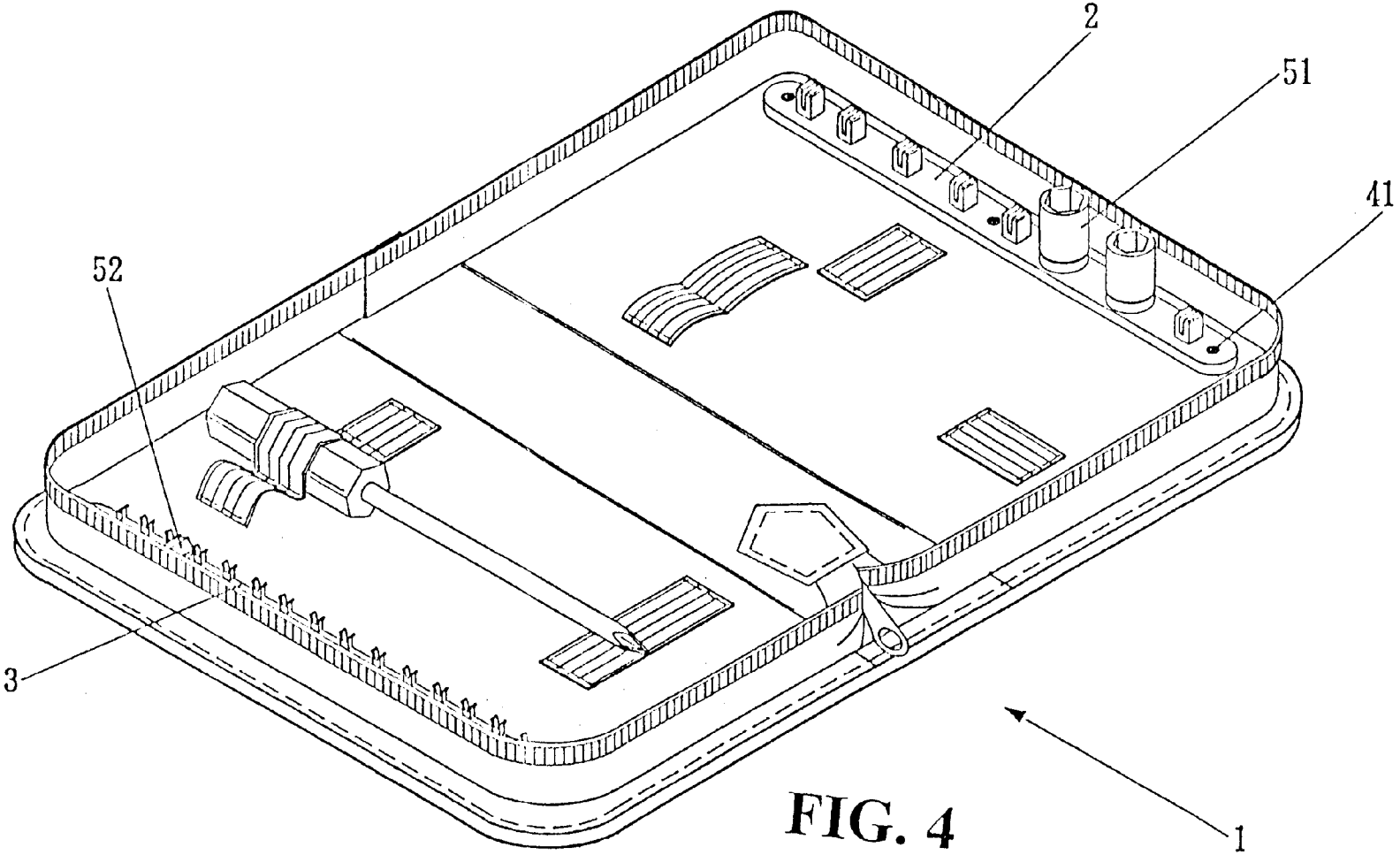
FIG. 4 is a perspective view, illustrating the positioning of sleeves and tips of screwdrivers on the tool holding seat, of the present invention.
Figure 5:
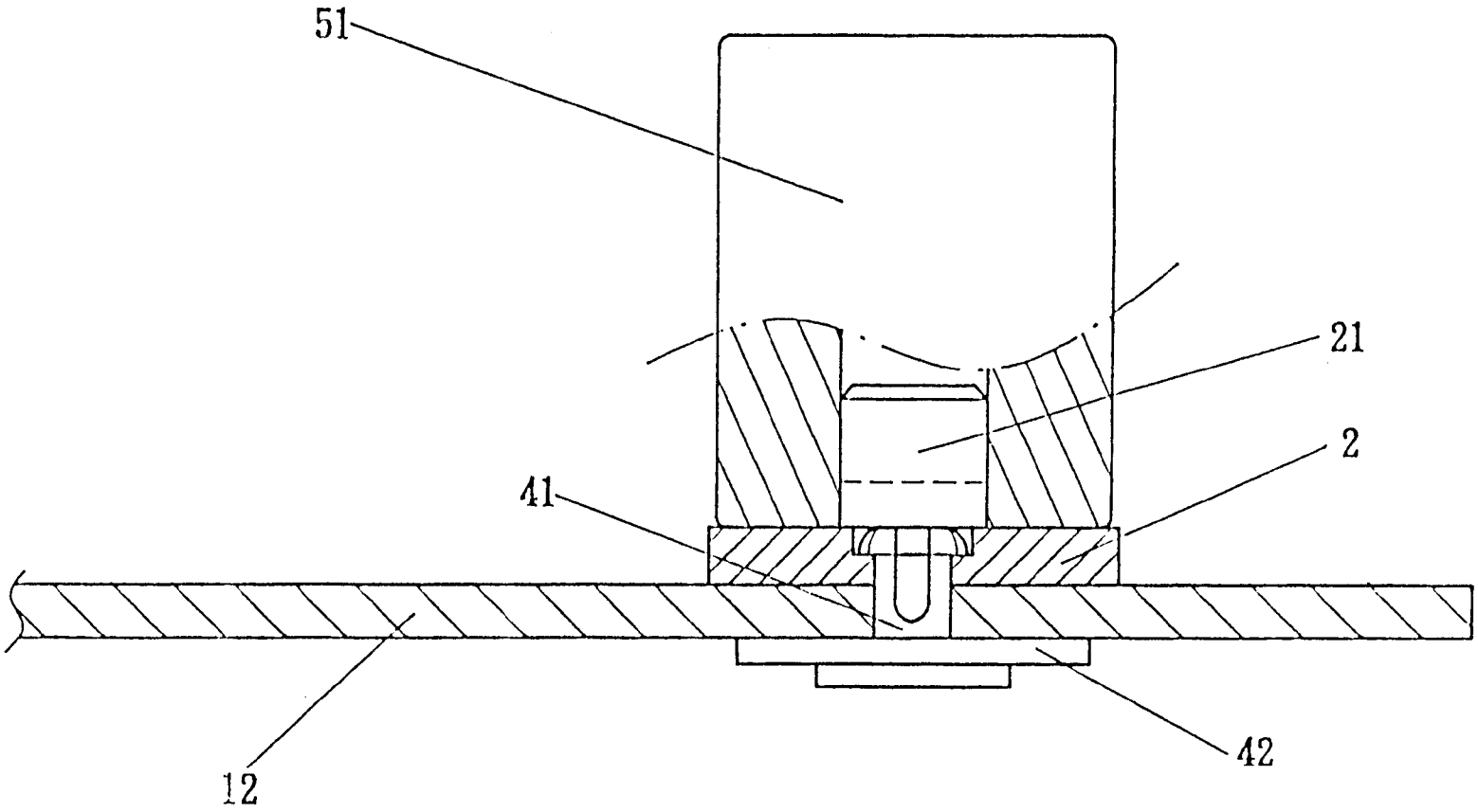
FIG. 5 is a sectional view, illustrating the mounting of the tool holding seat to the interior positioning board by means of the protruded dovetails passes through a circular pad and a corresponding hole of the tool holding seat.

FIG. 4 is a preferred embodiment of the present invention. In accordance with the present invention, the tool holding seat 2 and the tip holding seat 3 can be detachably connected by the protruded dovetail 41 to the interior positioning board 12. The arrangement of the tip holding seat 3 and the tool holding seat 2 can be varied in accordance with the numbers and type of sleeves 51 and tips 52 which are to be mounted thereto.

Figure 7:
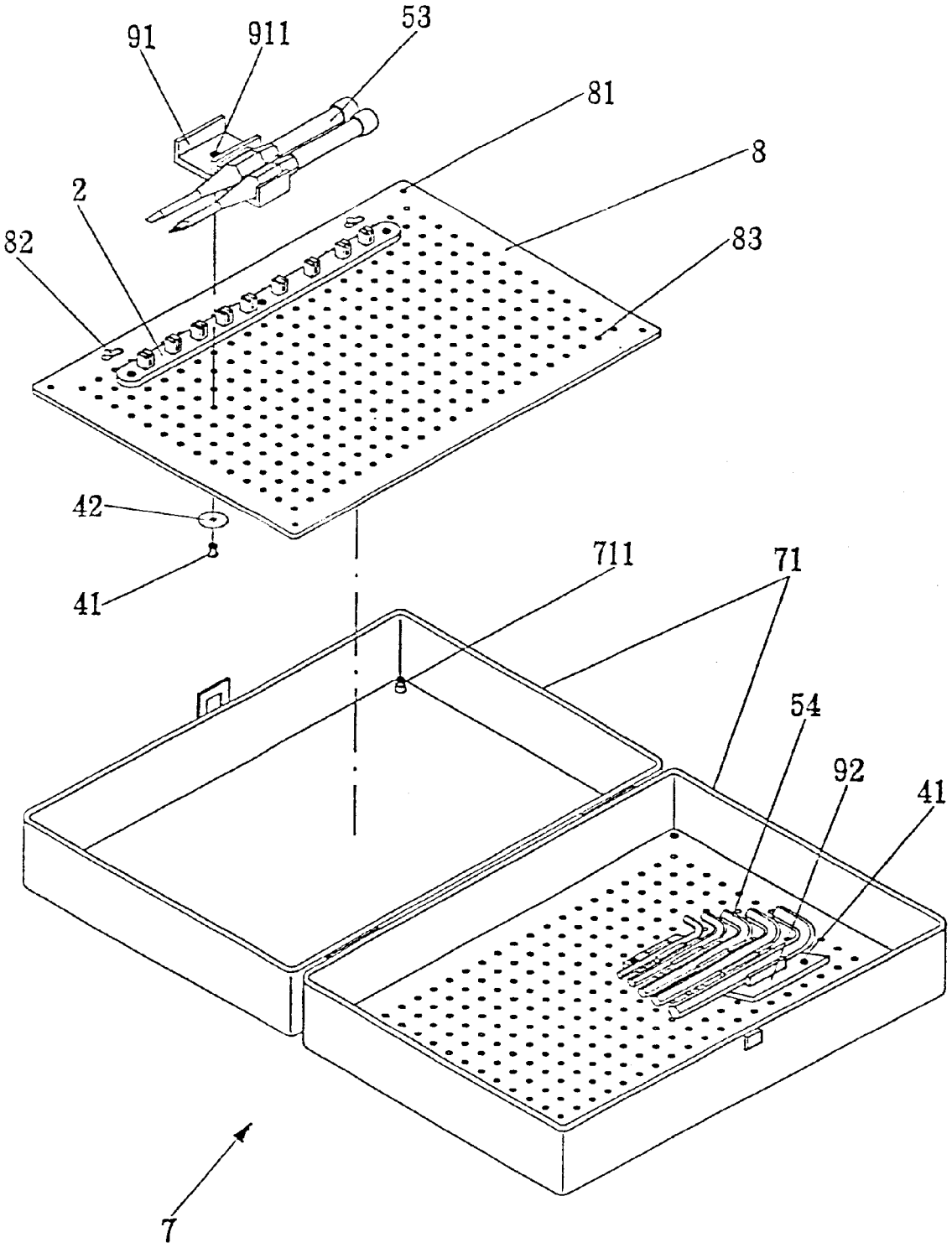
FIG. 7 shows the mounting of the tool holding seat onto the interior positioning board of a tool box in accordance with the present invention.

Referring to FIG. 7, there is shown an exploded view of the tool holding seat 2 of the present invention. In accordance with the present invention, the box 7 comprises two half opened box body 71 and two interior positioning boards 8, wherein the bottom face of the box body 71 is provided with four protruded dovetail 711 which can be used to mount together with the interior positioning board via the round hole 81 thereon, and fastened the inner-liner positioning board 8. Before the two interior positioning boards 8 are mounted with the box body 71, the protruded dovetail 41 passes through the interior positioning board 8 from the bottom face thereof and through a circular pad 42 and the plurality of round hole 83 on the interior positioning board 8. The top end of the protruded dovetail 41 forms an inverted hook.

The protruded dovetail 41 engages with the screwdriver tip holding seat 3, a precise driver 53 holding seat 91 and a hex wrench 54 holding seat 92. Thus, a tool box for tool holding is thus obtained.

In accordance with the present invention, an engaging hole 911 is provided to the holding seat 91 of the precise screwdriver 53. The hole 911 is used to position with the protruded dovetail 41. Similarly, an engaging hole (not shown) is also provided to the hex wrench 54 holding seat 92, and one edge of the interior positioning board 8 is provided with a pair of apertures 82 for positioning.

Figure 8:
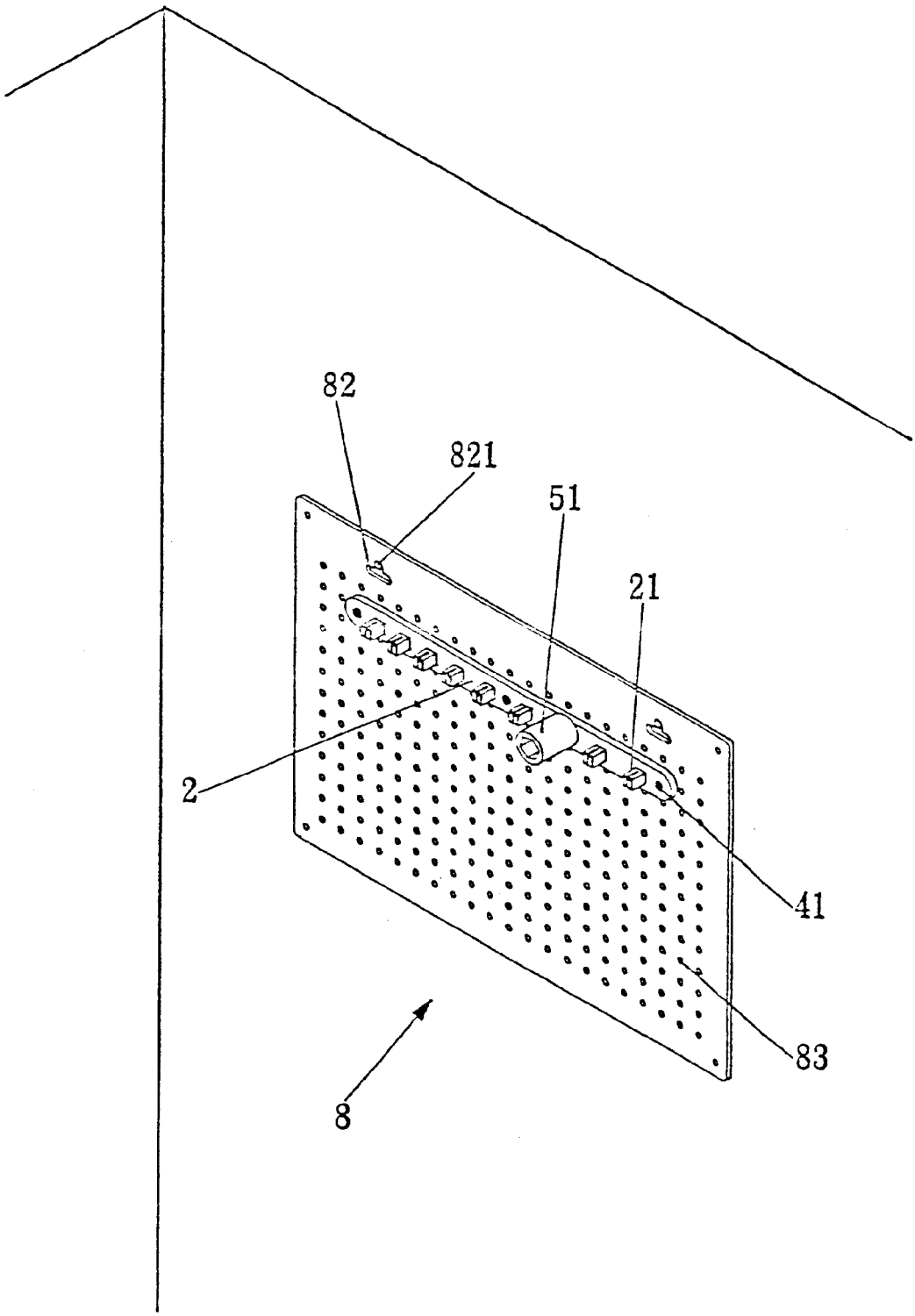
FIG. 8 shows the mounting of the tool holding seat onto a tool board in accordance with the present invention.
Figure 9:
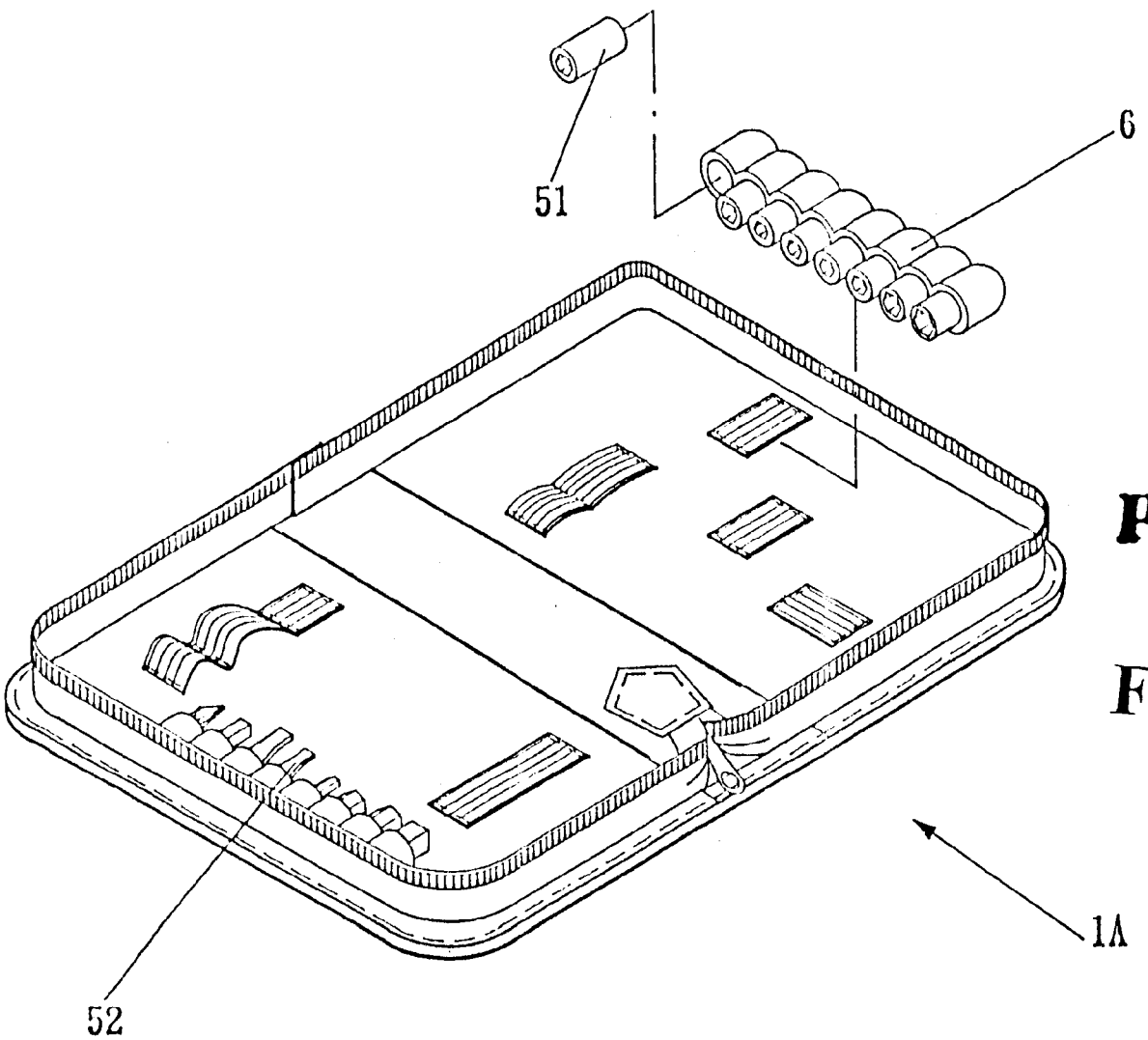
PRIOR ART FIG. 9
FIG. 9 is a perspective view of a conventional tool holding seat.

Furthermore, referring to FIG. 8, the tool holding seat can be used independently as that used on the interior positioning board 8 of FIG. 7. In accordance with the present invention, the tool board with the tool holding seat can be hung onto the mounting pin 821 positioned on the wall via the apertures provided on the tool board.

Numerous variations and modifications can be made without departing from the invention. Accordingly, it should be understood that the form of the invention described above is illustrative only and is not intended to limit the scope of the invention.

What is claimed is:

1. An improved structure of a tool box comprising:

a tool box cover enclosing an interior positioning board;

a zipper formed along edge of said tool box to provide zipping of said tool box;

a tool holding seat having a top surface being mounted with a plurality of engaging members, arranged at an equal interval to each other, wherein top surface of said engaging members is provided with either a linear slot or a cross-shaped slot to form an elastic engaging element and mounted onto said interior positioning board and along one vertical edge of said tool box; and a screwdriver tip holding seat having a plurality of clipping members, being arranged on the surface thereof and at equal interval to each other, and mounted onto said interior positioning board and along another vertical edge of said tool box, and a plurality of fasteners for detachably mounting said tool holding seat onto said interior positioning board after each of said fasteners passes through a corresponding circular pad and a corresponding circular hole provided on said tool holding seat;

whereby a plurality of sleeves for a wrench are inserted into said engaging members, which can be easily taken down for use, and said tool holding seat can be detachably replaced to accommodate numbers and types of tools.

* * * * *